US007207688B2

(12) United States Patent
Yuen et al.

(10) Patent No.: US 7,207,688 B2
(45) Date of Patent: Apr. 24, 2007

(54) INTERACTIVE SHOE LIGHT DEVICE

(76) Inventors: Wong Wai Yuen, Flat 2, 30/F, Kam Tai Court, Kam Hing House, Ma On Shan, N.T. (HK); Wong Kui Hang, Flat 2, 30/F, Kam Tai Court, Kam Hing House, Ma On Shan, N.T. (HK)

( * ) Notice: Subject to any disclaimer, the term of this patent is extended or adjusted under 35 U.S.C. 154(b) by 0 days.

(21) Appl. No.: 11/208,274

(22) Filed: Aug. 18, 2005

(65) Prior Publication Data

US 2007/0041193 A1 Feb. 22, 2007

(51) Int. Cl.
*F21W 121/06* (2006.01)
*F21V 21/08* (2006.01)

(52) U.S. Cl. ..... 362/103; 362/800; 315/200 A; 315/360; 315/323

(58) Field of Classification Search ..... 362/103; 315/200 A, 360, 323
See application file for complete search history.

(56) References Cited

U.S. PATENT DOCUMENTS

| | | | |
|---|---|---|---|
| 1,597,823 | A | 8/1926 | Randolph |
| 1,933,243 | A | 10/1933 | De Merolis et al. |
| 2,572,760 | A | 10/1951 | Rikelman |
| 2,634,407 | A | 4/1953 | Johnson |
| 2,671,209 | A | 3/1954 | Habib |
| 2,671,847 | A | 3/1954 | Lerch |
| 2,816,284 | A | 12/1957 | Campanell |
| 2,849,819 | A | 9/1958 | Murphy et al. |
| 2,931,893 | A | 4/1960 | Gonzalez Arias et al. |
| 2,959,892 | A | 11/1960 | Johnson |
| 2,976,622 | A | 3/1961 | Shearouse |
| 3,008,038 | A | 11/1961 | Dickens et al. |
| 3,053,949 | A | 9/1962 | Johnson |
| 3,070,907 | A | 1/1963 | Rocco |
| 3,502,831 | A | 3/1970 | McRoskey |
| 3,564,232 | A | 2/1971 | Ellerbe |
| 3,731,022 | A | 5/1973 | Loftus |
| 3,800,133 | A | 3/1974 | Duval |
| 3,893,247 | A | 7/1975 | Dana, III |
| 3,946,505 | A | 3/1976 | Dana, III |

(Continued)

FOREIGN PATENT DOCUMENTS

| | | |
|---|---|---|
| EP | 0 121 026 A1 | 10/1984 |

(Continued)

*Primary Examiner*—Sandra O'Shea
*Assistant Examiner*—Leah S. Lovell
(74) *Attorney, Agent, or Firm*—Brinks Hofer Gilson & Lione

(57) ABSTRACT

An interactive shoe light device includes at least one power source, at least one motion switch to generate an activation signal in response to an electrical engagement within the motion switch, the activation signal indicating at least duration of electrical engagement within the motion switch, an integrated circuit functioning as a controller, the integrated circuit electrically connected to the motion switch to receive the activation signal, and lighting elements electrically connected to the integrated circuit. The lighting elements are selectively actuated by the integrated circuit to illuminate the lighting elements in one or more predetermined illumination patterns depending on the duration of electrical engagement indicated by the activation signal. For a short duration, all lighting elements flash in a flashing pattern for a pre-determined period. For a long duration, only one lighting element lights up and continues for a few seconds after the switch is opened.

3 Claims, 6 Drawing Sheets

U.S. PATENT DOCUMENTS 3,968,641 A 7/1976 Moyer
4,009,387 A 2/1977 Nuver
4,014,115 A 3/1977 Reichert
4,020,572 A 5/1977 Chiaramonte, Jr.
4,128,861 A 12/1978 Pelengaris
4,130,951 A 12/1978 Powell
4,158,922 A 6/1979 Dana, III
4,231,079 A 10/1980 Heminover
4,253,253 A 3/1981 McCormick
4,298,917 A 11/1981 Ware
4,308,572 A 12/1981 Davidson et al.
4,350,853 A 9/1982 Ganyard
4,363,502 A 12/1982 Bakerman
4,367,515 A 1/1983 Beard
4,412,205 A 10/1983 Von Kemenczky
4,422,719 A 12/1983 Orcutt
4,459,645 A 7/1984 Glatter
4,463,412 A 7/1984 Broach
4,489,957 A 12/1984 Holmgren
4,518,274 A 5/1985 Hanggi
4,588,387 A 5/1986 Swenson
4,701,146 A 10/1987 Swenson
4,765,701 A 8/1988 Cheslak
4,800,469 A 1/1989 Leon
4,848,009 A 7/1989 Rodgers
4,870,325 A 9/1989 Kazar
4,897,947 A 2/1990 Kass-Pious
4,995,294 A 2/1991 Kashio et al.
5,016,144 A 5/1991 DiMaggio
5,027,035 A 6/1991 McGrail et al.
5,033,212 A 7/1991 Evanyk
5,052,131 A 10/1991 Rondini
5,070,431 A 12/1991 Kitazawa et al.
5,099,192 A 3/1992 Thayer et al.
5,113,325 A 5/1992 Eisenbraun
5,128,842 A 7/1992 Kenmochi
5,188,447 A 2/1993 Chiang et al.
5,235,761 A 8/1993 Chang
5,237,760 A 8/1993 Altman et al.
5,285,586 A 2/1994 Goldston et al.
5,303,131 A 4/1994 Wu
5,303,485 A 4/1994 Goldston et al.
5,313,187 A 5/1994 Choi et al.
5,327,329 A 7/1994 Stiles
5,343,190 A 8/1994 Rodgers
5,353,441 A 10/1994 Lazorchak
5,357,697 A 10/1994 Lin
5,371,662 A 12/1994 Shen-Ko
5,381,615 A 1/1995 MacMillan
5,388,038 A 2/1995 Yang
5,396,720 A 3/1995 Hwang et al.
5,400,232 A 3/1995 Wong
5,406,724 A 4/1995 Lin
5,408,764 A 4/1995 Wut
5,419,061 A 5/1995 Barrocas
5,422,628 A 6/1995 Rodgers
5,438,488 A 8/1995 Dion
5,438,493 A 8/1995 Tseng
5,455,749 A 10/1995 Ferber
5,456,032 A 10/1995 Matsumoto et al.
5,457,900 A 10/1995 Roy
5,461,188 A 10/1995 Drago et al.
5,463,537 A 10/1995 Trattner et al.
5,465,197 A 11/1995 Chien
5,475,572 A 12/1995 Tseng
5,477,435 A 12/1995 Rapisarda et al.
5,477,437 A 12/1995 Lach
5,483,759 A 1/1996 Silverman
5,485,358 A 1/1996 Chien
5,490,338 A 2/1996 Hwang et al.
5,495,136 A 2/1996 Chiang et al.
5,495,682 A 3/1996 Chen
5,500,635 A 3/1996 Mott
5,508,899 A 4/1996 McCormick
5,516,149 A 5/1996 Moore
5,523,928 A 6/1996 Kim
5,544,967 A 8/1996 Yao
5,546,681 A 8/1996 Goldston et al.
5,550,721 A 8/1996 Rapisarda
5,552,971 A 9/1996 Madden
5,566,479 A 10/1996 Gray et al.
5,575,554 A 11/1996 Guritz
5,577,828 A 11/1996 Nadel et al.
5,588,734 A 12/1996 Talamo et al.
5,590,945 A 1/1997 Simms
5,599,088 A 2/1997 Chien
5,604,999 A 2/1997 Barker
5,617,304 A 4/1997 Huang
5,644,858 A 7/1997 Bemis
5,649,755 A 7/1997 Rapisarda
5,653,523 A 8/1997 Roberts
5,656,805 A 8/1997 Plesko
5,663,614 A 9/1997 Weng et al.
5,664,862 A 9/1997 Redmond et al.
5,673,996 A 10/1997 Ducker
5,683,164 A 11/1997 Chien
5,709,464 A 1/1998 Tseng
5,716,119 A 2/1998 Patel
5,722,757 A 3/1998 Chien
5,730,520 A 3/1998 Hsu et al.
5,730,539 A 3/1998 Chabria
5,732,486 A 3/1998 Rapisarda
5,735,592 A 4/1998 Shu
5,746,499 A 5/1998 Ratcliffe et al.
5,746,500 A 5/1998 Chien
5,754,064 A 5/1998 Chien
5,758,946 A 6/1998 Chen
5,779,344 A 7/1998 Tseng
5,789,716 A 8/1998 Wang
5,812,063 A 9/1998 Weng et al.
5,813,148 A 9/1998 Guerra
5,821,858 A 10/1998 Stone
5,839,814 A 11/1998 Roberts
5,844,377 A 12/1998 Anderson et al.
5,855,382 A 1/1999 Reilly et al.
5,866,987 A 2/1999 Wut
5,894,201 A 4/1999 Wong
5,894,686 A * 4/1999 Parker et al. ..... 36/137
5,903,103 A 5/1999 Garner
5,909,088 A 6/1999 Wut
5,921,653 A 7/1999 Chien
5,932,975 A 8/1999 Wut ..... 315/119
5,934,784 A 8/1999 Dion
5,945,911 A 8/1999 Healy et al.
5,955,712 A 9/1999 Zakutin
5,957,541 A 9/1999 Seigler
5,969,311 A 10/1999 Mader
5,969,479 A 10/1999 Wong
6,012,822 A 1/2000 Robinson ..... 362/103
6,060,673 A 5/2000 Jackman
6,065,851 A 5/2000 So
6,094,141 A 7/2000 Tsai
6,099,185 A 8/2000 Huang et al.
6,104,140 A 8/2000 Wut et al.
6,106,132 A 8/2000 Chen
6,112,437 A 9/2000 Lovitt
6,129,473 A 10/2000 Shu
6,145,999 A 11/2000 Van Derlande
6,158,871 A 12/2000 Geddes et al.
6,164,794 A 12/2000 Rodgers
6,170,968 B1 1/2001 Caswell
RE37,220 E 6/2001 Rapisarda et al.
6,241,371 B1 6/2001 Dai
6,246,186 B1 6/2001 Nieberger

| | | | |
|---|---|---|---|
| 6,261,018 | B1 | 7/2001 | Chen |
| 6,280,045 | B1 | 8/2001 | Anteby et al. |
| 6,332,692 | B1 | 12/2001 | McCurdy |
| 6,348,766 | B1 | 2/2002 | Ohishi et al. |
| 6,354,712 | B1 | 3/2002 | Anteby |
| 6,360,615 | B1 | 3/2002 | Smela |
| 6,398,395 | B1 | 6/2002 | Hyun |
| 6,408,545 | B1 | 6/2002 | Song |
| 6,416,327 | B1 | 7/2002 | Wittenbecher |
| 6,525,487 | B2 | 2/2003 | Wei |
| 6,619,812 | B2 | 9/2003 | Rapisarda |
| 2003/0137852 | A1 | 7/2003 | Rapisarda |
| 2003/0185019 | A1 | 10/2003 | Rogers et al. |

FOREIGN PATENT DOCUMENTS

| | | | |
|---|---|---|---|
| EP | 0 335 467 | B1 | 6/1993 |
| EP | 0 773 529 | B1 | 5/1997 |
| EP | 0 888 034 | A2 | 12/1998 |
| GB | 2 361 624 | A | 10/2001 |

* cited by examiner

INTERACTIVE SHOE LIGHT DEVICE

FIELD OF THE INVENTION

The present invention relates generally to clothing and accessories, and more particularly to an improved system for illuminating devices incorporated into clothing and accessories.

BACKGROUND

Lighting systems have been incorporated into footwear, generating distinctive flashing lights when a person wearing the footwear walks or runs. These systems generally have an inertia switch, so that when the heel of a runner strikes the pavement, the switch activates the flashing light system. The resulting light flashes are useful in identifying the runner, or at least the presence of the runner, due to the easy-to-see nature of the flashing lights.

These lighting systems, however, suffer from a number of deficiencies. There is typically no on-off switch for the lighting system, and thus the system is "on" all the time, draining the power source, which is typically a small battery. Even if the only portion of the system that is operating is an oscillator or timer, the power drain over time is cumulative, this leading to shorter-than-desirable battery life. It would be desirable to have some other means for turning the lighting system on or off, especially through the use of an external motion.

Another deficiency is that many flashing or intermittent light systems only have one light pattern. While one light pattern makes the user more visible, there is no provision for varying or making the pattern interesting dependent on the type of movement of the user. It would be desirable to have some system for activating different light patterns depending on the type of movement of the user.

Yet another deficiency in current lighting systems is that most lighting elements cease to illuminate as soon as the user ceases the motion. Thus, most current systems do not provide a function to the user for controlling one predetermined lighting element to illuminate for a few seconds after the user ceases the motion. Therefore, it is desirable to provide a shoe light device that allows for extended illumination even after the switch is opened.

Another deficiency is that many components that currently make up lighting systems are made with toxic components that do not meet environmental regulations of many countries. Due to the fact lighting systems are incorporated in footwear, it is especially desirable for lighting systems to be made of components that are non-toxic, and therefore not harmful to those wearing the shoes. Additionally, when shoes become worn out and are discarded, it is desirable for the components in the shoes to be made of materials that will not be harmful to the environment. Therefore, it is desirable to have a lighting system for footwear made of non-toxic components that meet environmental regulations of many countries.

SUMMARY OF THE INVENTION

According to an aspect of the present invention, an interactive shoe light device includes at least one power source, at least one motion switch to generate an activation signal in response to an electrical engagement within the at least one motion switch, the activation signal indicating at least one of duration of electrical engagement within the at least one motion switch, an integrated circuit functioning as a controller, the integrated circuit electrically connected to the at least one motion switch to receive the activation signal, and lighting elements electrically connected to the integrated circuit. The lighting elements selectively actuated by the integrated circuit to illuminate the lighting elements in one or more predetermined illumination patterns dependant on the duration of electrical engagement indicated by the activation signal. For a short duration of electrical engagement all lighting elements flash in a flashing pattern for a pre-determined period and for a long duration of electrical engagement only one lighting element lights up or flashes and continues for a few seconds after the switch is opened. The flashing pattern and the flashing duration are not interrupted by a short duration of electrical engagement.

According to another aspect, a method of illuminating a series of lighting elements includes creating a first activation signal based on electrical engagement within a first motion switch, based on the first activation signal, determining a duration of electrical engagement within the first motion switch for a period of time, and illuminating a least one of a series of lighting elements in response to activation of the first motion switch. For a short duration of electrical engagement all lighting elements flash in a flashing pattern for a pre-determined period and for a long duration of electrical engagement only one lighting element lights up or flashes and continue for a few seconds after the switch is opened. The flashing pattern and the flashing duration are not interrupted by a short duration of electrical engagement.

DETAILED DESCRIPTION

Figure 1:
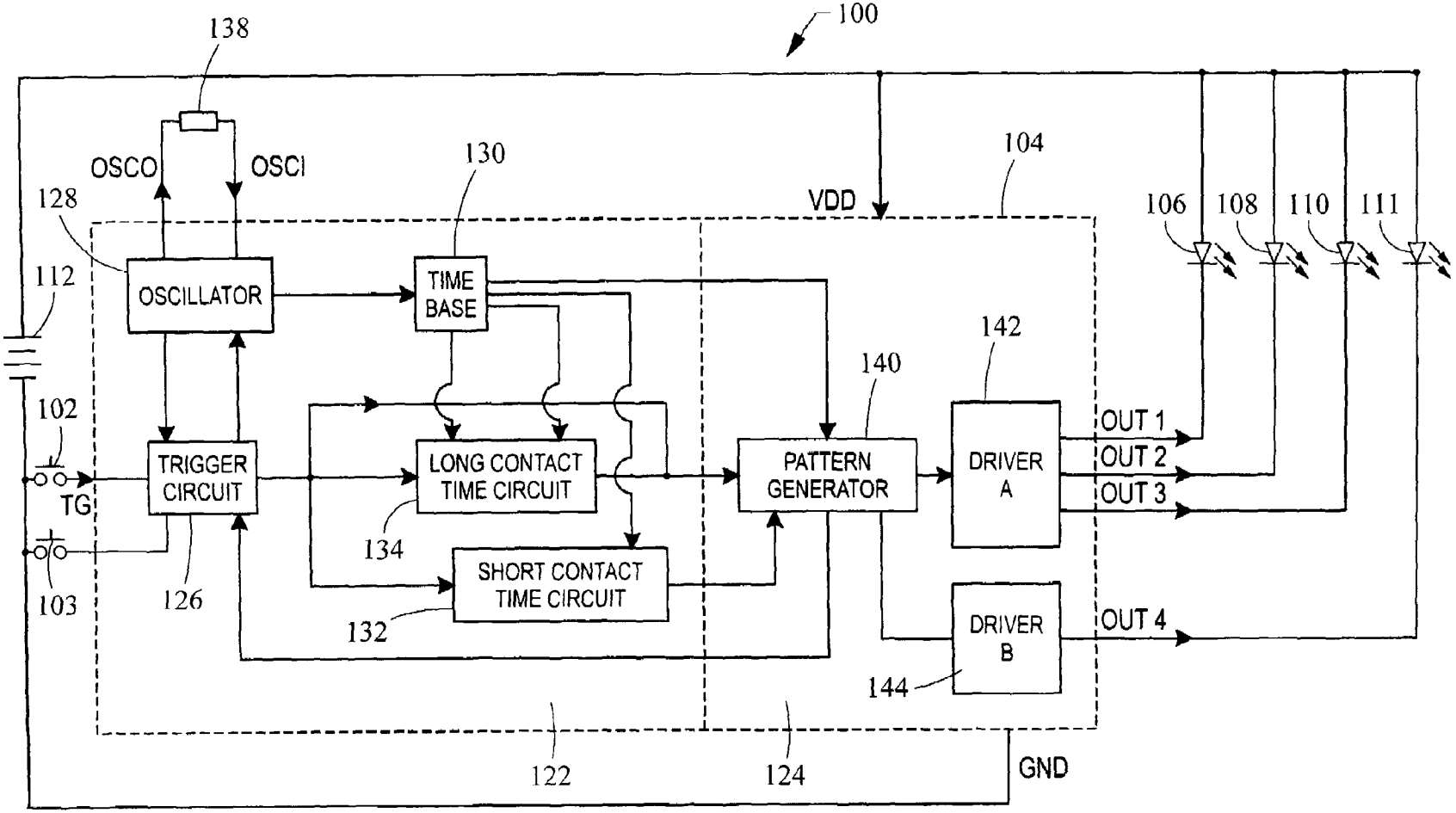
FIG. 1 depicts a block diagram of an interactive shoe light device in accordance with one embodiment of the current invention.

As shown in FIG. 1, an interactive shoe light device 100 includes a power source 112, a motion switch 102, a controller 104, and a series of lighting elements 106, 108, 110 and 111. In general, movement of the motion switch 102 triggers the controller 104. The controller 104 analyzes the movement of the motion switch 102, and in response to that general movement, illuminates the series of lighting elements 106, 108, 110 and 111 in one or more predetermined patterns. In one example, the interactive shoe light device 100 is incorporated in a shoe or other footwear. The controller 104 and motion switch 102 are contained, for example, in a hollow portion of the shoe sole and the lighting elements 106, 108, 110 and 111 are positioned along sides of the shoe for maximum visibility.

Figure 2:
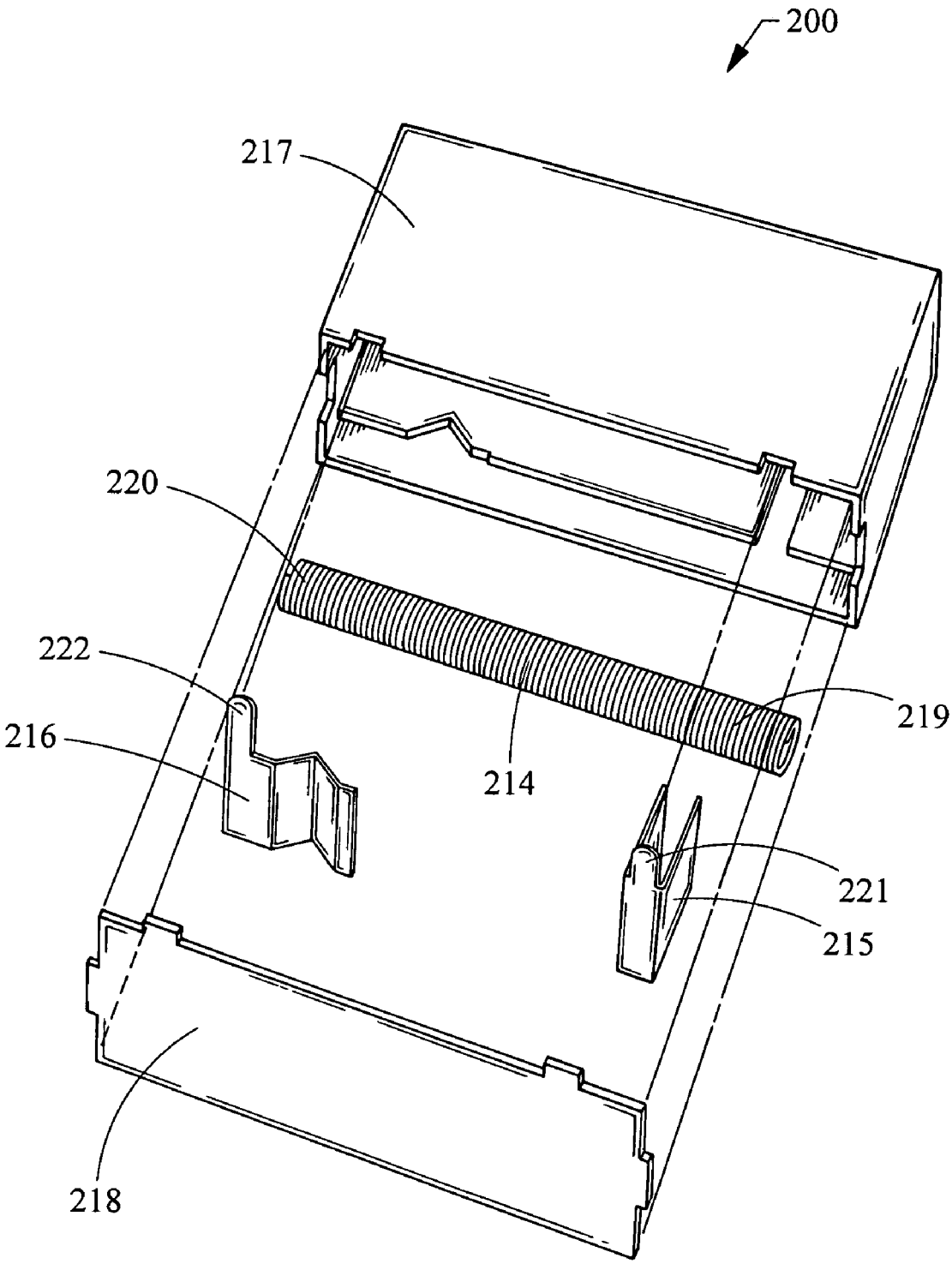
FIG. 2 is an exploded view of a spring motion switch.

Preferably the motion switch 102 is an inertia switch such as a spring motion switch, but any motion switch 102 known in the art can be used. FIG. 2 is an example of a spring motion switch 200 used in the interactive shoe light device 100 of FIG. 1. The spring motion switch 200 is shown in exploded view. As shown in FIG. 2, the spring motion switch 200 preferably includes a spring 214, spring stand 215, a metal arch 216, a plastic housing 217 and a plastic cover 218. The metal arch 216 and the spring stand 215 each have a tail 221, 222. This tail is used to conduct electric current. The spring 214 is generally made of electrically conductive material such as metal wire wrapped in a cylindrical shape and is positioned at the spring stand 215 to have a fixed end 219 and a free end 220. The free end 220 of the spring 214 is positioned proximate the metal arch 216 so that the free end 220 of the spring 214 electrically engages the contact or arch 216 during movement of the spring motion switch 200.

Preferably the spring 214 within the spring motion switch 200 moves between two general positions. In a first position, the free end 220 of the spring 214 is a sufficient distance from the metal arch 216 so that an electric current cannot pass between the spring 214 and the metal arch 216, creating an open circuit through the spring motion switch 200. This spring is normally in the first position when the spring motion switch 200 is stationary. In a second position, the free end 220 of the spring 214 bends so that it electrically engages the metal arch 216, creating a closed circuit in the spring motion switch 200 between the free end 220 of the spring 214 and the metal arch 216 so that, if an appropriate bias voltage is applied, an electric current can pass through the spring motion switch. The spring motion switch 200 is normally in the second position at different points during movement of the spring motion switch 200.

The periodically closed circuit within the spring motion switch 200 due to the movement of the free end 220 of spring 214 between the first and second position creates an activation signal. It is this activation signal that the spring motion switch 200 provides to the controller 104 when the spring motion switch 200 is activated. It should also be noted that an additional motion switch 103 can be added to the interactive shoe light device 100, as depicted in FIG. 1, so that the device 100 operates in response to movement of different parts of an object.

In other examples, the motion switch 102 (FIG. 1) could also be a magnetic reed switch (FIGS. 6A and 6B) or a buzzer switch (not shown). If a magnetic reed switch is used, at least two magnetic contacts having a free end and a fixed end are positioned proximate to each other so that the free ends of the metal contacts electrically engage due to the magnetic flux of a magnet when the magnet is placed near the free ends of the two magnetic contacts. In this manner, the reed switch is actuatable by the magnet.

Preferably, the magnet is placed in a specially designed housing to hold the magnet. In one example, an internal magnet is placed within the shoe to sense motion of the switch. Typically, the housing holding the interior magnet defines a space to allow the magnet to move along the axis of the housing during movement. In another example, an external magnet is placed outside the shoe. Preferably, the external magnet is fixed in a specially designed plastic housing to allow the user to move the magnet near the magnetic reed switch to cause an electrical engagement within the magnetic reed switch which generates a signal to actuate the integrated circuits. The magnetic reed switch generates a similar activation signal to that of the spring motion switch 102 illustrated in FIG. 2 where current does not normally flow through the magnetic reed switch but when a magnet is periodically placed near the magnetic reed switch, due to periodic electrical engagement of the contacts, an activation signal is created having properties of duration of electrical engagement for a period of time.

Referring again to FIG. 1, the controller 104 includes a signal analysis system 122 and a pattern generator system 124. In general, the signal analysis system 122 analyzes the activation signal which the controller 104 detects from the motion switch 102 and the pattern generator system 124 receives commands from the signal analysis system 122 and generates a dependant illumination pattern. In particular, the signal analysis system 122 preferably determines the duration of electrical engagement within the switch 102 from each pulse in the activation signal. In response to the duration of each electrical engagement, the signal analysis system 122 commands the pattern generator system 124 to illuminate the lighting elements 106, 108, 110 and 111 in one or more predetermined lighting patterns.

In one example, the signal analysis system 122 includes a trigger circuit 126, an oscillator 128, a time-base 130, a short contact signal circuit 132 and a long contact signal circuit 134. Initially, the trigger circuit 126 receives the activation signal from the motion switch 102. In response, the trigger circuit 126 actuates the oscillator 128, the short contact signal circuit 132, the long contact signal circuit 134, and the pattern generator system 124. When activated, the oscillator 128 creates a frequency signal with a time period dependant on an oscillation resistor 138. The oscillator resistor 138 can be modified to any value to adjust the frequency signal. This oscillator resistor 138 may be an external resistor or a built-in resistor. The oscillator 128 passes the frequency signal to the time-base 130, which creates a timing signal dependent on the time period of the frequency signal to control the timing of the short contact signal circuit 132, long contact signal circuit 134, and pattern generator system 124.

At generally the same time that the time-base 130 signals the short contact circuit 132 and the long contact circuit 134, the trigger circuit 126 passes the activation signal to the short contact circuit 132 and the long contact circuit 134 for examination of the activation signal. Specifically, the short contact circuit 132 examines each pulse within the activation signal to determine whether the pulse length, and therefore the duration of electrical engagement within the motion switch 102, is less than or equal to a predetermined duration level. The predetermined duration level may be any length of time desired, but preferably, the duration level is set to be the same time period as the on-time of a light-emitting diode (LED) during flashing. For example, the predetermined duration level is set to 16 ms. If the short contact signal circuit 132 determines that the pulse length is equal to or less than the predetermined duration level, the short contact signal circuit 132 produces a short contact signal. The short contact circuit 132 and the long contact circuit 134 may be formed using any suitable circuitry such as digital logic components to measure pulse duration.

The long contact signal circuit 134 examines each pulse within the activation signal to determine whether the duration of electrical engagement is greater than the predetermined duration level. If the long contact signal circuit 134 determines that the pulse length is greater than the predetermined duration level, the long contact signal circuit 134 produces a long contact signal. The predetermined duration of the long contact signal circuit 134 may be the same as or different from the predetermined duration of the short contact signal circuit 132.

In one example, the pattern generator system 124 includes a pattern generator 140, an A LED driver 142 and a B LED driver 144. Preferably, the pattern generator system 124 creates different types of lighting patterns in response to detecting the short contact signal and the long contact signal.

The pattern generator system 124 can be programmed or arranged to react differently to any of these signals, but preferably, the pattern generator system 124 is programmed to illuminate the lighting elements 106, 108, 110 and 111 in one or more different predetermined lighting sequences each time the short contact signal circuit 132 signals the pattern generator system 124. For example, in response to a short contact signal, the short contact signal circuit 132 sends a control signal to the pattern generator 140, which enables A LED driver 142 to actuate the lighting elements 106, 108 and 110 with a flashing pattern in a pre-determined duration. The flashing pattern and the flashing duration are not interrupted when signaled by the short contact signal circuit 132.

However, the pattern generator system 124 is preferably programmed to interrupt the lighting sequence and illuminate one lighting element when signaled by the long contact signal circuit 134. For example, in response to a long contact signal, the long contract signal circuit 134 sends a control signal to the pattern generator 140, which enables A LED driver 142 and/or B LED driver 144 to actuate one predetermined lighting element 106, 108, 110 or 111. This lighting element 106, 108, 110 or 111 will be flashing or illuminating continuously. Moreover, when the switch opens, this light element 106, 108, 110 or 111 will be flashing or illuminating continuously for a predetermined duration such as a few more seconds. In one specific example, the predetermined duration during which the light element remains illuminated is in the range 2 to 5 seconds. However, any duration may be selected.

Figure 3:
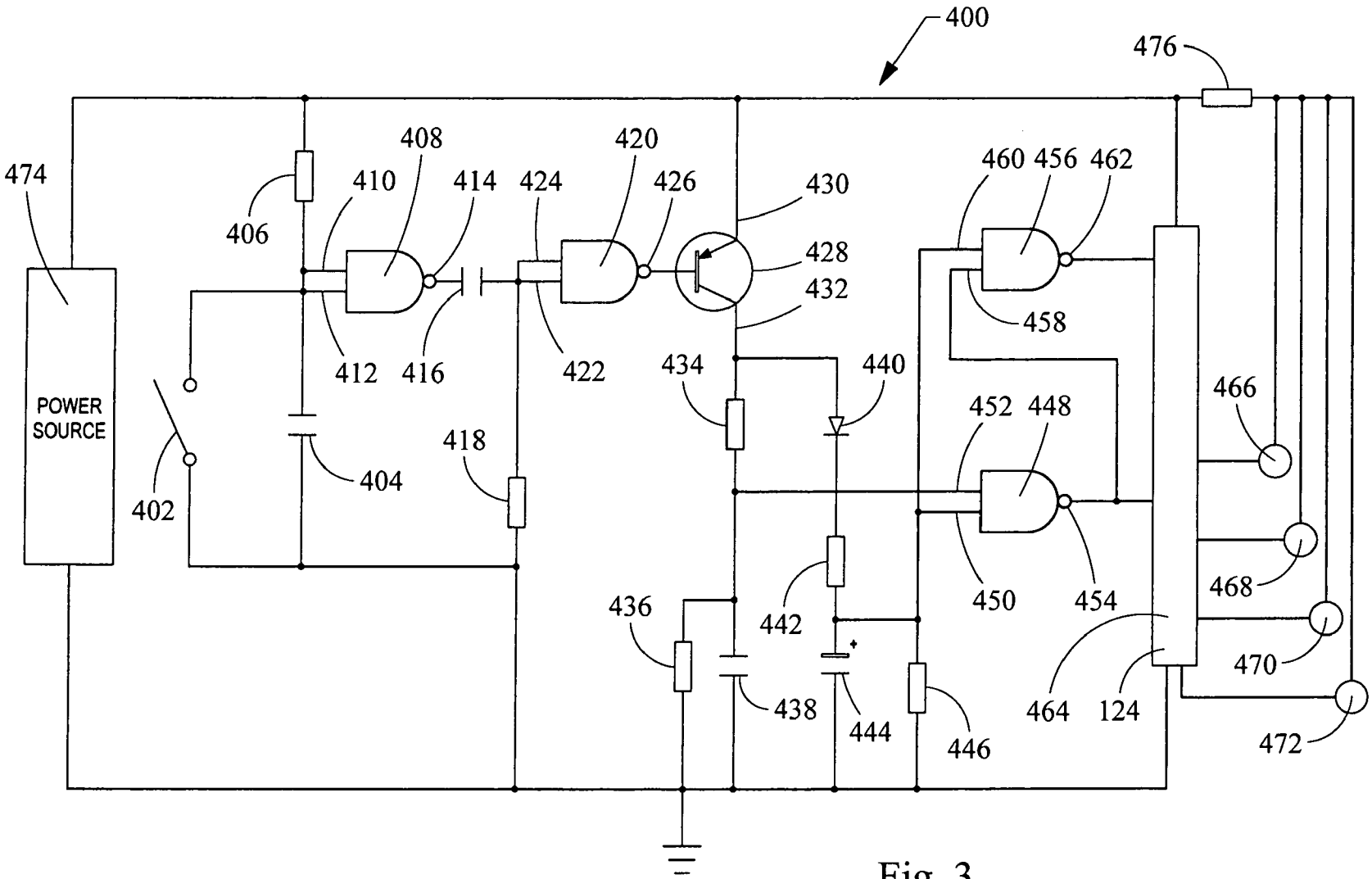
FIG. 3 depicts circuit diagram of FIG. 1.

An exemplary circuit illustrating one example of an interactive shoe light device 400 is shown in FIG. 3. In this example, the trigger circuit 126, oscillator 128, time-base 130, short contact signal circuit 132 and long contact signal circuit 134 (FIG. 1) are implemented through resistors 406, 418, 434, 436, 442, 446 and 476; capacitors 404, 416, 438, and 444; NAND gates 408, 420, 448, and 456; a diode 440; and a transistor 428. Additionally, the pattern generator system 124 is implemented through an integrated circuit 464.

The pattern generator system 124 may be any number of integrated circuits useful for controlling the flashing of the lighting elements 466, 468, 470 and 472 in the device 400. One example of such an integrated circuit, manufactured with complementary metal-oxide semiconductor (CMOS) technology for one-time programmable, read-only memory, is Model No. EM78P153S, made by EMC Corp., Taipei, Taiwan. Other examples of integrated circuits include MC14017BCP and CD4107AF; custom or application specific integrated circuits; CMOS circuits, such as a CMOS 8560 circuit; or M1320 and M1389 RC integrated circuits made by MOSdesign Semiconductor Corp., Taipei, Taiwan. The CMOS integration circuit is small in dimensions and consumes little standby energy. Thus, it is useful in small size products and it provides useful life to the device 400.

Generally, motion switch 402, resistor 406, and capacitor 404 connect to the inputs 410, 412 of NAND gate 408. Resistor 406 connects between the power source 474 and the inputs 410, 412 of NAND gate 408 while the motion switch 402 and capacitor 404 connect between the inputs 410, 412 of NAND gate 408 and ground. The output 414 of NAND gate 408 connects to capacitor 416, which connects to the inputs 422, 424 of NAND gate 420. Resistor 418 also connects between the inputs 410, 412 of NAND gate 408 and ground. The output 426 of NAND gate 420 connects to the base of transistor 428, while the emitter 430 of transistor 428 connects to the power supply 474. The collector 432 of transistor 428 connects to ground via a resistor-capacitor combination consisting of resistor 434, resistor 436, and capacitor 438. The common node between resistor 434, resistor 436, and capacitor 438 additionally connects to input 452 of NAND gate 448.

The collector 432 of transistor 428 also connects to ground via diode 440, resistor 442, and capacitor 444. The common node between resistor 442 and capacitor 444 connects to input 450 of NAND gate 448. Resistor 446 connects between input 450 of NAND gate 446 and ground. Input 460 to NAND gate 456 also connects to input 450 of NAND gate 448 while input 458 to NAND gate 456 connects to the output of NAND gate 448. NAND gate 456 has an output 462 and NAND gate 448 has an output 454. The outputs 454, 462 to NAND gates 448 and 456, respectively connect to the pattern generator 124, which additionally connects to the power supply 474 and the lighting elements 466, 468, 470 and 472.

Before operation of the frequency controlled lighting system 400, the inputs 410, 412 to NAND gate 408 are biased to a high voltage state. The high inputs at NAND gate 408 result in a low output at NAND gate 408, forcing the inputs of NAND gate 420 to a low voltage state. The low voltage of the inputs 420, 424 to NAND gate 420 result in a high output at the base of transistor 428. Therefore, due to the fact there is not a sufficient voltage drop across the transistor, the transistor 428 does not conduct and no current passes through transistor 428. For this reason, capacitors 438 and 444 do not charge and over time fully dissipate any charge stored in the capacitors over resistor 436 or resistor 446. Thus, input 460 of NAND gate 456 and the inputs of NAND gate 448 are low dictating the output of NAND gate 456 and NAND gate 448 to be at a high state before operation of the interactive shoe light device.

During movement of the motion switch 402 in one example, the switch 402 produces a signal as a result of the free end 220 of the spring 214 electrically engaging the metal contact 216. The electrical engagement of the spring 214 and the contact 216 creates a closed circuit, allowing current to flow through the motion switch 402 and force the inputs of NAND gate 408 to change from high to low. The change in voltage state of the inputs to NAND gate 408 results in the output of NAND gate 408, and therefore the inputs of NAND gate 420, to change from low to high. The change in voltage state of the inputs to NAND gate 420 forces the output of NAND gate 420 to low.

Since the output of NAND gate 420 is connected to the base of transistor 428, as the base voltage of transistor 428 goes from high to low, transistor 428 begins conducting. As current flows through transistor 428, capacitor 438 begins charging through resistor 434 and discharging through resistor 436. Preferably, resistor 434 is larger than resistors 436 and 442 so that capacitor 438 does not charge to a high enough level to change the voltage state of input terminal 452 of NAND gate 448 from low to high during a short electrical engagement within the motion switch 402.

As current flows through transistor 428, capacitor 444 also charges. Preferably, capacitor 444 charges to a high level, causing input terminal 450 to NAND gate 448 and input terminal 460 to NAND gate 456 to change from low to high. Therefore, due to the fact input terminal 452 to NAND gate 448 remains low and input terminal 450 to NAND gate 448 changes from low to high, the output of NAND gate 448 remains high. Further, since input terminal 460 to NAND gate 456 changes from low to high and input terminal 458 to NAND gate 456 remains high, the output of NAND gate 456 changes from high to low. This change in output from NAND gate 456 signals the pattern generator 464 to actuate the lighting elements 466, 468, 470 and 472 in a predetermined flashing pattern. Resistor 476 is coupled between the power supply 474 and lighting elements 466, 468, 470 and 472 to limit current when these devices are actuated. The output of NAND gate 448 at a high voltage state while the output of NAND gate 456 is at a low voltage state is the short contact signal.

Preferably, the pattern generator 124 is programmed to illuminate the lighting elements 466, 468, and 470 in a different pattern each time it receives the short contact signal. For example, if the lighting elements 466, 468, and 470 are outputs 1, 2, and 3, the first time the pattern generator 124 receives the short contact signal it illuminates the lights in the sequence 1-2-3-1-2-3-1-2-3 where the number 1, 2, and 3 refer to LEDs 466, 468, and 470 respectively. The second time the pattern generator 124 receives the short contact signal it illuminates the lights in the sequence 2-3-1-2-3-1-2-3-1. The third time the pattern generator 124 receives the short contact signal it illuminates the lights in the sequence 3-1-2-3-1-2-3-1-2. The pattern generator 124 continues illuminating the lighting elements 466, 468, and 470 in different patterns each time it receives a short contact signal.

During production of the predetermined flashing pattern, if the motion switch 402 closes for a long duration such as 16 ms, the inputs to NAND gate 408 change from high to low for a long period of time, resulting in the output of NAND gate 408 changing from low to high for a long period of time. Due to the change in output of NAND gate 408, the inputs to NAND gate 420 again change from low to high, causing the output to NAND gate 420 to change to low. Since the base of transistor 428 is connected to the output of NAND gate 420, transistor 428 starts conducting. Transistor 428 conducts for a large period of time due to the long duration of electrical engagement within the motion switch within the switch 402. Therefore, capacitors 438 and 444, which charge when current flows through transistor 428, are able to store a relatively high charge and establish a relatively high voltage drop between ground and input 452 of NAND gate 448. The high charge of capacitor 438 forces input terminal 452 of NAND gate 148 to high. Additionally, the high charge of capacitor 444 forces input terminal 450 to NAND gate 448 and input terminal 460 to NAND gate 456 to high.

The change in the voltage state of the input terminals to NAND gate 448 drives the output of NAND gate 448 to low. Due to this change in the output of NAND gate 448, input terminal 458 to NAND gate 456 also changes from high to low, resulting in the output of NAND gate 456 changing to high. The change in outputs of NAND gates 448 and 456 signals the pattern generator 464 to freeze any current flashing pattern of the pattern generator 464. Preferably, the output of the pattern generator 464 is frozen until capacitors 438 and 444 discharge to a low enough level that NAND gates 448 and 456 return to their standby state of high. The output of NAND gate 448 being at a low voltage state while the output of NAND gate 456 is at a high voltage state is the long contact signal.

Figure 4A:
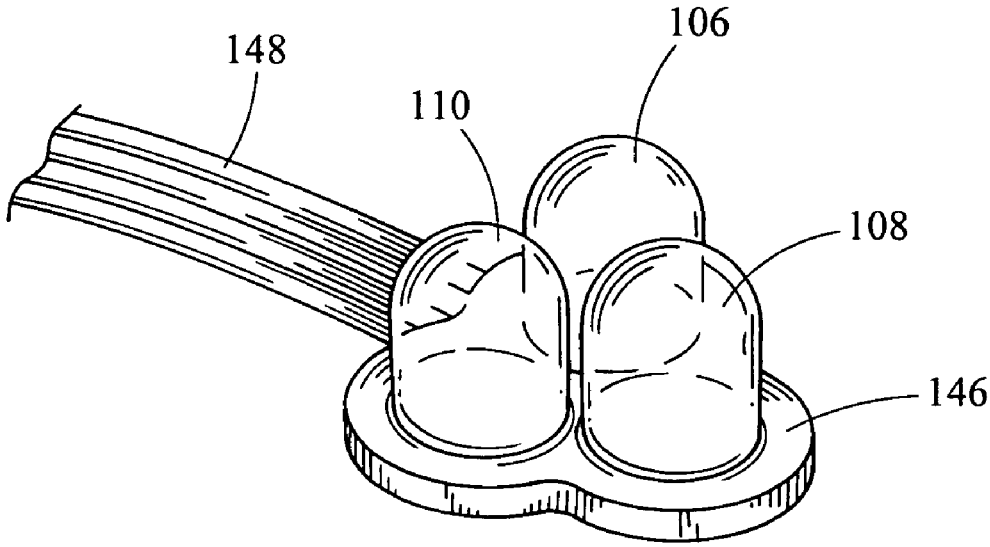
FIG. 4A depicts a perspective view of the placement of the lighting elements of the interactive shoe light device.
Figure 4B:
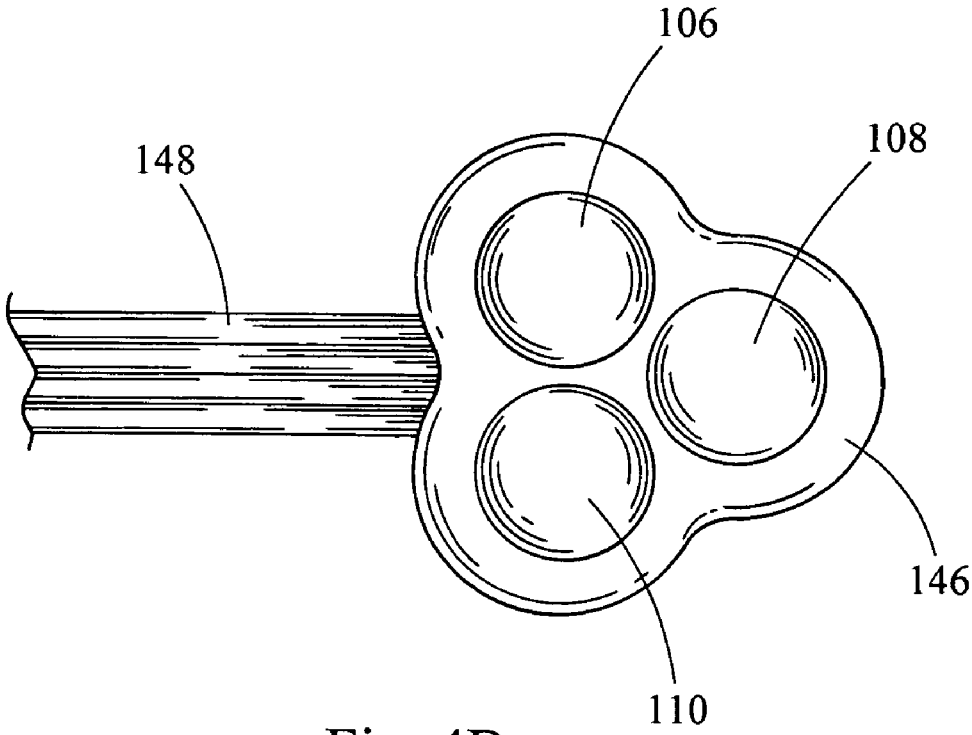
FIG. 4B depicts a top view of FIG. 4A.

The lighting elements 106, 108 and 110 can be located independently or can be grouped together at any visible part of the shoe to present different colors and to present different lightning patterns. FIGS. 4A and 4B show an example of the placement of the lighting elements 106, 108 and 110, where they are placed in a triangular form closely packed on a printed circuit board 146. The printed circuit board 146 is electronically connected to the controller 104 by a wire 148. This placement allows for unique flashing patterns. For example, at least two different color lighting elements may illuminate together in a flashing pattern. This arrangement can produce mix-color phenomenon with a lower cost when compared to bi-colored LEDs or tri-colored LEDs. The LED drivers 142 and 144 may have the same or different current output magnitudes for obtaining the same or different brightness of the lighting elements. The device 100 may also use ultra-violet LEDs as lighting elements 106, 108, 110 and 111 to enhance their aestheticity. Moreover, a ultra-violet sensitive flexible or non-flexible plastic cover or strip may be used to increase the lighting area of the ultra-violet LEDs.

Figure 5:
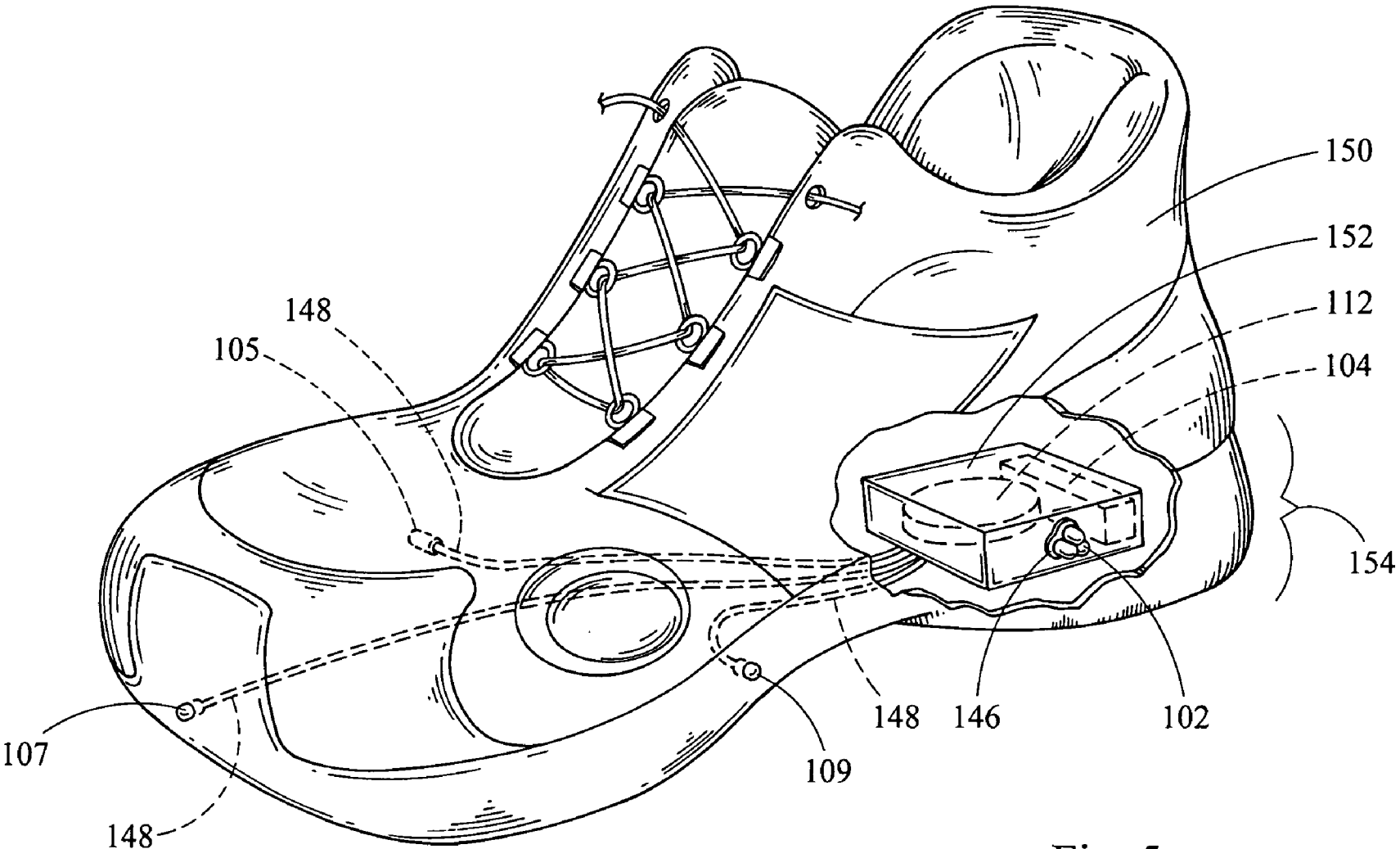
FIG. 5 depicts a perspective view of the interactive shoe light device installed in a shoe.

The components of the interactive shoe light device 100 can be placed anywhere throughout footwear, but preferably proximate a heel 154 of a shoe 150 as shown in FIG. 5. It should be noted that the interactive shoe light device 100 can be incorporated into other objects, such as safety vests, barrettes, headbands and bracelets. The power source 112, the motion switch 102 and the controller 104 are preferably encapsulated by a housing 152 to improve the shock and water resistance of the device 100. Additionally, during movement such as running or walking, a user normally strikes the heel 154 against the ground with a sufficient force to activate the motion switch 102. The lighting elements 105, 107 and 109 are preferably fixed on various visible parts of the shoe surface, connected to the controller 104 by wires 148.

Figures 6A, 6B:
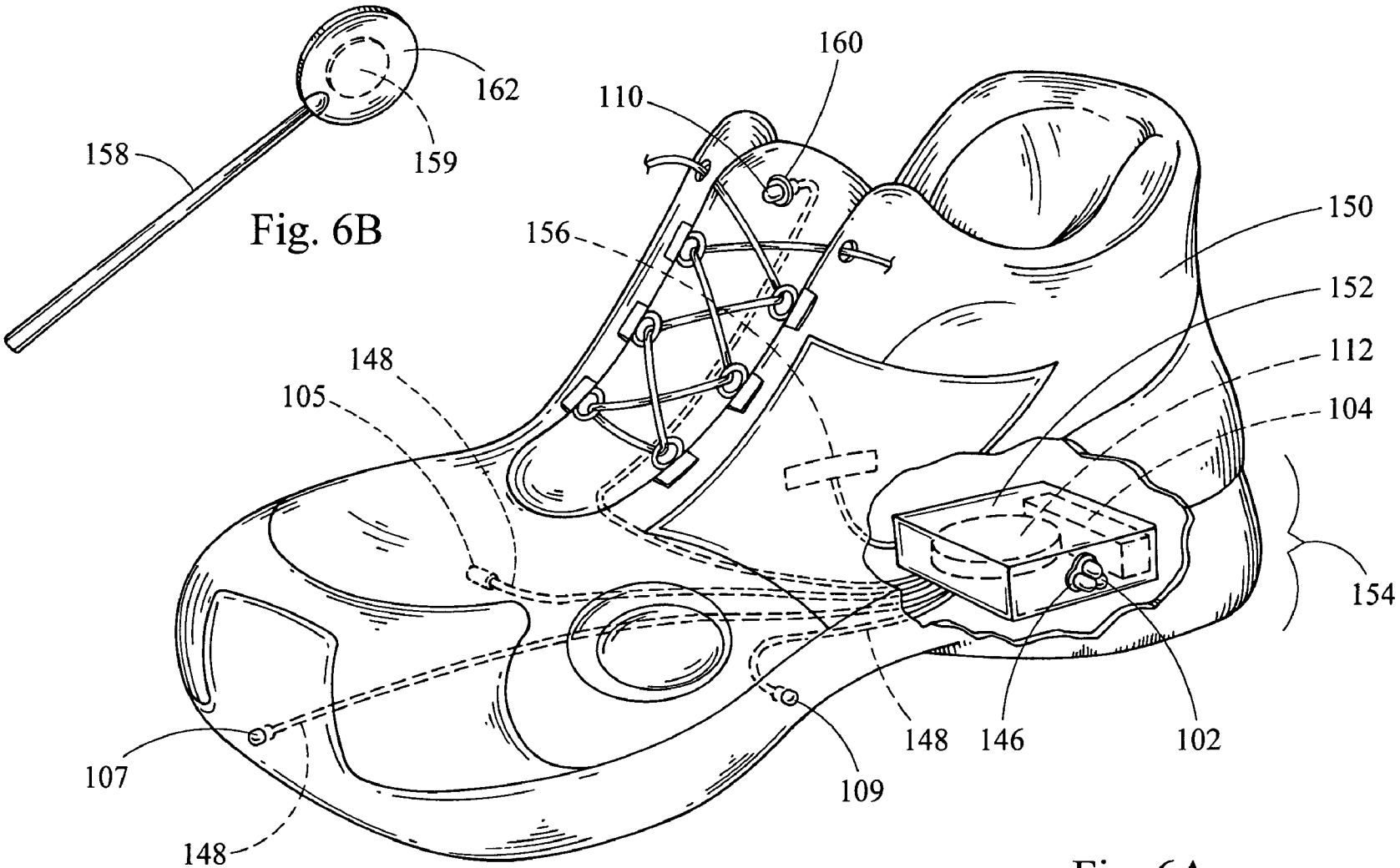
FIG. 6A depicts a perspective view of the interactive shoe light device installed in a shoe having a reed switch actuatable by a magnetic wand.
FIG. 6B depicts the close up view of area A of FIG. 6A.

FIGS. 6A and 6B show the placement of the interactive shoe light device 100 in a shoe 150 having a reed switch 156 and a magnetic wand 158. The power source 112 and the controller 104 may be encapsulated the same way as mentioned above, as depicted in FIG. 6A. One pre-determined lighting element 110 can be placed into a flashlight reflector 160 to concentrate the light beam. The reed switch 156 may be fixed on a part of the shoe surface. The magnetic wand 158 is preferably made of plastic such as Nylon and contains a slot 159 to retain a magnet 162, as depicted in FIG. 6B. When the wand 158 gets near the reed switch 156, the reed switch 156 closes. It is noted that the reed switch 156 can be replaced by any kinds of mechanical switches known in the art.

The examples described herein overcome issues of previous lighting systems concerning shorter-than-desired battery life due to unnecessary battery drain by allowing a user to deactivate a flashing pattern through external motions. Alleviating unnecessary power drain allows for a long-lasting product, allows for creation of smaller lighting systems, and allows for more complex lighting systems that will not drain a power source as quickly as previous less complex lighting system.

Additionally, the examples described herein overcome limitations of previous lighting systems by providing the interactive shoe light device 100 that creates multiple lighting patterns in response to movement of the device 100. Multiple lighting patterns provide greater visibility for the user to increase safety. Additionally, multiple illumination patterns create more interesting lighting patterns to increase the aesthetic value of the shoe.

All the circuits described and many other circuits may be used in achieving the result of the interactive shoe light device 100 that illuminates different lighting patterns in response to movement of a motion switch. Additionally, many of the lighting elements of the interactive shoe light device 100 may be implemented. For instance, while LEDs are clearly preferred, LEDs with different colors, Ultra-violet LEDs, or other types of lamps may also be used, such as incandescent lamps or filament lamps.

Examples of the power supply 112 may include batteries such as CR2032, CR2450, LR44, LR03 or any other known in the art. Preferably, in order to fulfill environmental protection regulations for various countries, the circuits and other objects used in the interactive shoe light device 100 may consist of non-toxic components. For example, the solder and other components of the circuits may be free of lead (Pb), cadmium, mercury or chromium, or more than one of these elements. Examples of lead-free solder include Sn-07Cu, SN99, Sn—Ag3.5, and Sn—Ag—Cu provided by Shing Hing Solder Co., Ltd. As used herein, "free" means the contents of the toxic elements in the components contain less than a predefined percentage which meets the basic requirements for the environmental regulation percentages of a country.

It is therefore intended that the foregoing detailed description be regarded as illustrative rather than limiting, and that it be understood that it is the following claims, including all equivalents, that are intended to define the spirit and scope of this invention. Any of these improvements may be used in combination with other features, whether or not explicitly described as such. Other embodiments are possible within the scope of this invention and will be apparent to those of ordinary skill in the art. Therefore, the invention is not limited to the specific dates, representative embodiments, and illustrated examples in this description.

What is claimed is:

1. An interactive shoe light device comprising:

at least one power source;

at least one motion switch to generate an activation signal in response to an electrical engagement within the at least one motion switch, the activation signal indicating a duration of electrical engagement within the at least one motion switch, the at least one motion switch including a reed switch actuatable by an external magnet;

an integrated circuit functioning as a controller, the integrated circuit electrically connected to the at least one motion switch to receive the activation signal, the integrated circuit including a trigger circuit, an oscillator, a time-base, a short contact signal circuit and a long contact signal circuit, the trigger circuit configured to actuate the oscillator and pass the activation signal to the short contact circuit and the long contact circuit for analysis, the time-base configured to signal the short contact signal circuit and the long contact signal circuit, the short contact signal circuit configured to produce the short contact signal, and the long contact signal circuit configured to produce the long contact signal; and lighting elements electrically connected to the integrated circuit, the lighting elements selectively actuated by the integrated circuit to illuminate the lighting elements in one or more predetermined illumination patterns dependant on the duration of electrical engagement indicated by the activation signal;

wherein for a relatively short duration of electrical engagement, all lighting elements flash in a flashing pattern for a pre-determined period and for a relatively long duration of electrical engagement, only one lighting element lights up or flashes and continue for a predetermined duration after the switch is opened.

2. The interactive shoe light device of claim 1, wherein the oscillator comprises an oscillator resistor electronically connected to the oscillator, the oscillator configured to create a frequency signal with a time period dependent on the oscillator resistor and to pass the frequency signal to the time-base.

3. An interactive shoe light device comprising:

at least one power source;

at least one motion switch to generate an activation signal in response to an electrical engagement within the at least one motion switch, the activation signal indicating a duration of electrical engagement within the at least one motion switch;

an integrated circuit functioning as a controller, the integrated circuit electrically connected to the at least one motion switch to receive the activation signal, the controller including a signal analysis system configured to analyze the activation signal, and a pattern generator system configured to receive signals from the signal analysis system and generate a dependant illumination pattern in response thereto, the pattern generator system including a pattern generator, a first LED driver to actuate one or more of first, second and third lighting elements and a second LED driver to actuate a fourth lighting element; and lighting elements electrically connected to the integrated circuit, the lighting elements selectively actuated by the integrated circuit to illuminate the lighting elements in one or more predetermined illumination patterns dependant on the duration of electrical engagement indicated by the activation signal;

wherein for a relatively short duration of electrical engagement, all lighting elements flash in a flashing pattern for a pre-determined period and for a relatively long duration of electrical engagement, only one lighting element lights up or flashes and continue for a predetermined duration after the switch is opened.

* * * * *